US005484027A

United States Patent [19]

Greenlaw et al.

[11] Patent Number: 5,484,027

[45] Date of Patent: Jan. 16, 1996

[54] ICE PENETRATING HOT POINT

[75] Inventors: Robert T. Greenlaw, Westerly, R.I.; Jeffrey S. Kornblith, Mystic, Conn.

[73] Assignee: The United States of America as represented by the Secretary of the Navy, Washington, D.C.

[21] Appl. No.: 75,692

[22] Filed: Jul. 1, 1987

[51] Int. Cl.[6] ..... F25C 5/04

[52] U.S. Cl. ..... 175/18; 299/3

[58] Field of Search ..... 175/18; 299/3

[56] References Cited

U.S. PATENT DOCUMENTS

| | | | |
|---|---|---|---|
| 3,390,729 | 7/1968 | Aamot | 175/18 |
| 3,680,645 | 8/1972 | Horbach | 175/18 |
| 4,651,834 | 3/1987 | Eninger | 175/18 |

FOREIGN PATENT DOCUMENTS

| | | | |
|---|---|---|---|
| 350945 | 9/1972 | U.S.S.R. | 175/18 |
| 622932 | 8/1978 | U.S.S.R. | 175/18 |
| 950892 | 8/1982 | U.S.S.R. | 175/18 |
| 1023054 | 6/1983 | U.S.S.R. | 175/18 |
| 274752 | 7/1927 | United Kingdom | 175/18 |

*Primary Examiner*—Donald P. Walsh

*Attorney, Agent, or Firm*—Michael J. McGowan; Prithvi C. Lall; Michael F. Oglo

[57] ABSTRACT

A device for producing a small (approx. 1" diameter) penetration through ice quickly. The device is a penetrator having a conical shape. The penetrator includes a ceramic cone having spiral grooves that house a high resistance wire. The wire supplies heat upon being energized. A high thermal dielectric and a metallic shroud are placed over the cone and wire to provide uniform heating to the surrounding area and to prevent short-circuiting of the device.

5 Claims, 1 Drawing Sheet

ICE PENETRATING HOT POINT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a device for providing a penetration of about 1 inch diameter through ice quickly. The ice penetrated is normally covering the ocean. This enables the lowering of sensors or other apparatus to the water below.

(2) Description of the Prior Art

The means use prior to the present invention for ice penetration had many drawbacks. Explosives have the drawbacks of being hazardous, creating large craters rather than small penetrations and large amounts are required for large penetrations. Solid lithium and water reaction are both slow and hazardous. Chemical reactions such as ammonia reacting with ice to form a low temperature liquid are both slow and very hazardous. Augers were the most often used devices for drilling small holes through ice. For deep penetrations, sectional drill bits are required and a fixed drive unit is needed to counteract drive torque. Hot water jet drills are energy inefficient and gas generators are very hazardous.

SUMMARY OF THE INVENTION

An ice penetrating hot point device utilizes a high resistance wire that dissipates energy and melts its way through an ice field to the ocean below. The ice penetrator is conical in shape to enhance its capabilities. It can be mounted on a device as simple as a rod of sufficient length and then pushed through the ice. The electrical portions of the ice penetrator are electrically insulated to prevent short circuit, but are covered with heat transparent material so the the heat generated within the device is utilized for penetration purposes.

DESCRIPTION OF THE PREFERRED EMBODIMENT

Figure 1:
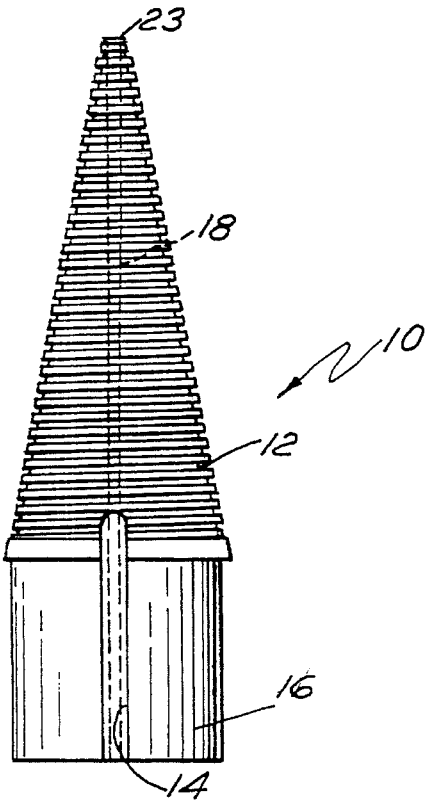
FIG. 1 is a pictorial representation of the ceramic cone utilized in the present invention.

Referring now to FIG. 1 there is shown a ceramic cone 10 having a spiral groove 12 and a straight outer surface groove 14 along a base 16 of the cone 10. The groove 14 is parallel to the conical axis. An aperture 18 extends along the entire axis of cone 10.

Figure 2:
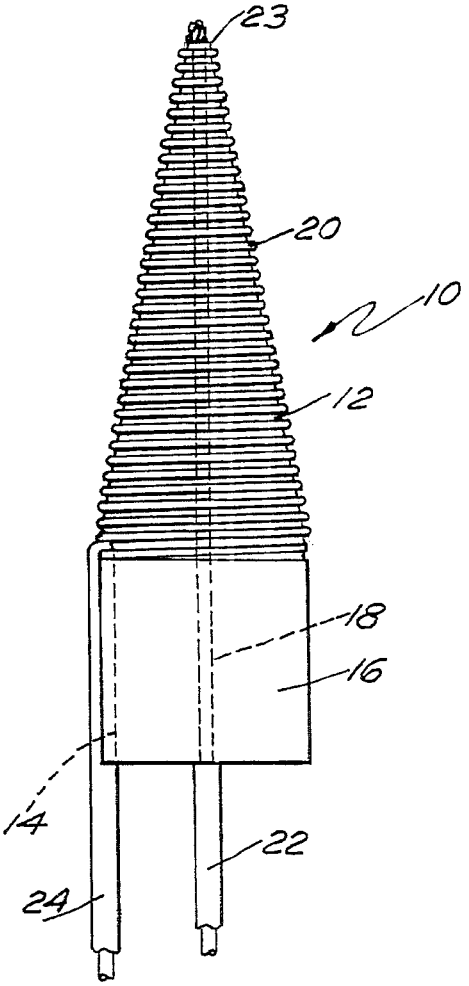
FIG. 2 shows the ceramic cone of FIG. 1 with additional components of the present invention.

Referring now to FIG. 2 there is shown the ceramic cone 10 with a wire made from a nickel-base alloy, containing chromium and iron having high electrical resistance and stability at high temperatures such as Nichrome wire 20 wrapped in the spiral groove 12 of FIG. 1 44. A large center conductor 22 extends through aperture 18 and connects to an end of the Nichrome wire 120 at the apex 23 of cone 10.

Another conductor 24 connects to the other end of Nichrome wire 20 along the base 16 of cone 10.

Figure 3:
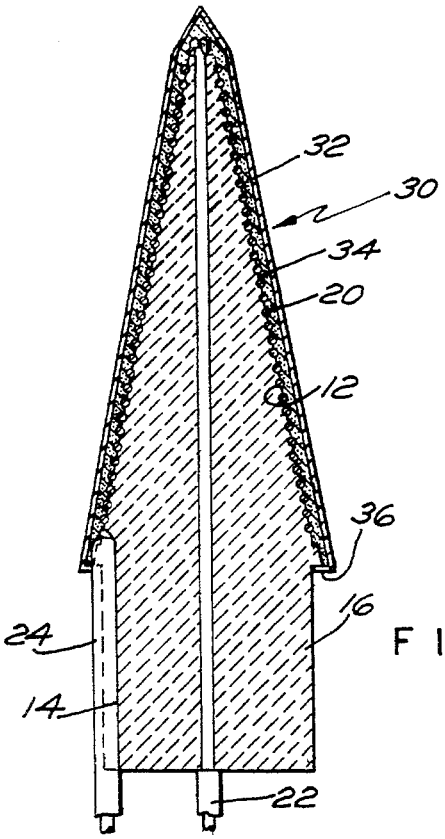
FIG. 3 shows the completed penetrator shroud of the present invention that includes the components of FIG. 2.

Referring now to FIG. 3 there is shown a complete penetrator 30. A solid metallic conical shroud 32 made of a suitable metal such as oxygen free copper is constructed in the shape of ceramic cone 10, but slightly larger so that the assembly shown in FIG. 2 above the base 16 can fit inside conical shroud 32 without contact occurring between the shroud 32 and the metallic components of FIG. 2.

A suitable dielectric 34 having a high thermal conductivity such as magnesium oxide is forced into the space between conical shroud 32 and the components of FIG. 2.

A voltage is applied to conductors 22 and 24. Since the Nichrome wire 20 has a much higher resistance than conductors 22 and 24, the voltage appears across the Nichrome wire 20. The Nichrome wire 20 generates heat by resistive heating. The heat is conducted away from the Nichrome wire 20 through dielectric 34 and metallic conical shroud 32.

In operation the conductors 22 and 24 are normally insulated. The complete penetrator shroud 30 can be conveniently mounted or supported by use of the cylindrical portion of the ceramic cone.

There has therefore been described a penetrator shroud 30 having a conical shape that increases the ice penetration rate and reduces excess radial mounting. The Nichrome wire 20 heat source is close to the ice source with only highly heat conductive material between the heat source and the ice being melted. Heat is distributed over the penetrator surface to maximize allowable power dissipation and penetration rate. The shape of the penetrator tip point allows rapid initial penetration and alignment. A large center conductor 22 reduces excess heat gain in the interior of cone 10. The spiral groove 12 on the ceramic cone 10 surface provides stability of the Nichrome wire 20 during assembly and operation, and prevents coil shortings during operation.

It will be understood that many additional changes in the details, materials, steps and arrangement of parts, which have been herein described and illustrated in order to explain the nature of the invention, may be made by those skilled in the art within the principle and scope of the invention as expressed in the appended claims.

We claim:

1. An ice penetrating device comprising:

a cone having spiral grooves on its outer surface;

a pair of terminal leads adjusted to receive a voltage;

an electrical wire having a substantial resistance spirally wrapped around said cone with said wire inserted in said spiral grooves of said cone, said wire being connected across said pair of terminal leads and said wire adapted to receive a voltage across it for dissipating heat;

a conical shroud placed over said cone; and a high thermal conductivity dielectric located between said cone and said conical shroud.

2. An ice penetrating device according to claim 1 wherein said cone further comprises an aperture through the cones axis inserting one of said pair of terminal leads for connecting to one end of said electrical wire having a substantial resistance and said cone further having a groove on its outer surface parallel to said axis for guiding the other end of said electrical wire having a substantial resistance and its associated terminal.

3. An ice penetrating device according to claim 2 wherein said cone is made of ceramic material.

4. An ice penetrating device according to claim 3 wherein said shroud is made of oxygen free copper.

5. An ice penetrating device according to claim 4 wherein said high thermal conductivity dielectric is magnesium oxide.

* * * * *